United States Patent [19]

Tojo et al.

[11] 4,396,364

[45] Aug. 2, 1983

[54] SCROLL FLUID APPARATUS WITH CRANKSHAFT BEARING LOCATED IN ORBITING PIN FORCE PLANE

[75] Inventors: Kenji Tojo; Masato Ikegawa; Masao Shiibayashi, all of Shimoinayoshi, Japan

[73] Assignee: Hitachi, Ltd., Tokyo, Japan

[21] Appl. No.: 243,070

[22] Filed: Mar. 12, 1981

[30] Foreign Application Priority Data

Mar. 12, 1980 [JP] Japan ..... 55-30412

[51] Int. Cl.[3] ..... F01C 1/02; F01C 17/06; F01C 21/02

[52] U.S. Cl. ..... 418/55; 418/59

[58] Field of Search ..... 418/55, 57, 59

[56] References Cited

U.S. PATENT DOCUMENTS 3,874,827 4/1975 Young ..... 418/55

4,303,379 12/1981 Hiraga et al. ..... 418/55

*Primary Examiner*—John J. Vrablik

*Attorney, Agent, or Firm*—Antonelli, Terry & Wands

[57] ABSTRACT

A scroll fluid apparatus in which a bearing of a plurality of bearings journaling a crankshaft which is closest to an orbiting scroll is located in a plane extending through the point of application of force transmitted between the orbiting scroll member and the crankshaft and disposed at a right angle to the center axis of the crankshaft, to minimize the moment of load applied to the bearings.

9 Claims, 4 Drawing Figures

SCROLL FLUID APPARATUS WITH CRANKSHAFT BEARING LOCATED IN ORBITING PIN FORCE PLANE

BACKGROUND OF THE INVENTION

This invention relates to a scroll fluid apparatus suitable for use as air compressor, refrigerant compressor, expander, hydraulic pump, etc.

Scroll fluid apparatus are disclosed in a number of patents including U.S. Pat. Nos. 3,884,599, 3,994,636 and 3,874,827, for example, and each have a pair of scroll members, each scroll member including an end plate and a wrap located thereon in upstanding position and one of the scroll members orbiting around the other scroll member while being prevented from apparently rotating on its own axis, to cause movable pockets defined between the two scroll members to undergo changes in volume. However, there are no reports in the literature of the prior art on proposals that have ever been made to minimize the moment of load applied to bearings for journaling a crankshaft for rotation.

Let us discuss this problem in some detail. A crankshaft is journaled by at least two bearings axially spaced apart from each other. Meanwhile the orbiting scroll member and the crankshaft are in engagement with each other outside the bearings. Thus the orbiting scroll member is supported in overhanging relation to the crankshaft. This means that the point of application of rotary force transmitted from the crankshaft to the orbiting scroll member and also from the orbiting scroll member to the crankshaft is disposed beyond the positions of the bearings. This gives rise to a moment of high magnitude which is the product of the transmitted force as multiplied by the distance at which the orbiting scroll member overhangs the crankshaft.

SUMMARY OF THE INVENTION

An object of the present invention is to provide a scroll fluid apparatus in which the load applied to the bearings for journaling the crankshaft can be minimized.

Another object of the present invention is to provide a scroll fluid apparatus in which the moment of load applied to the bearings for journaling the crankshaft can be minimized.

Still another object of the present invention is to provide a scroll fluid apparatus in which the bearings for journaling the crankshaft have a prolonged service life.

A further object of the present invention is to provide a scroll fluid apparatus in which the spacing between at least two bearings for journaling the crankshaft can be reduced.

The outstanding characteristic of the invention for accomplishing the aforesaid objects is that, of a plurality of bearings journaling the crankshaft, the bearing closest to the revolving scroll member is located in a plane in which is positioned the point of application of force which is concerned in transmittal of rotary force from the crankshaft to the orbiting scroll member and from the orbiting scroll member to the crankshaft.

DESCRIPTION OF THE PREFERRED EMBODIMENTS

Figure 1:
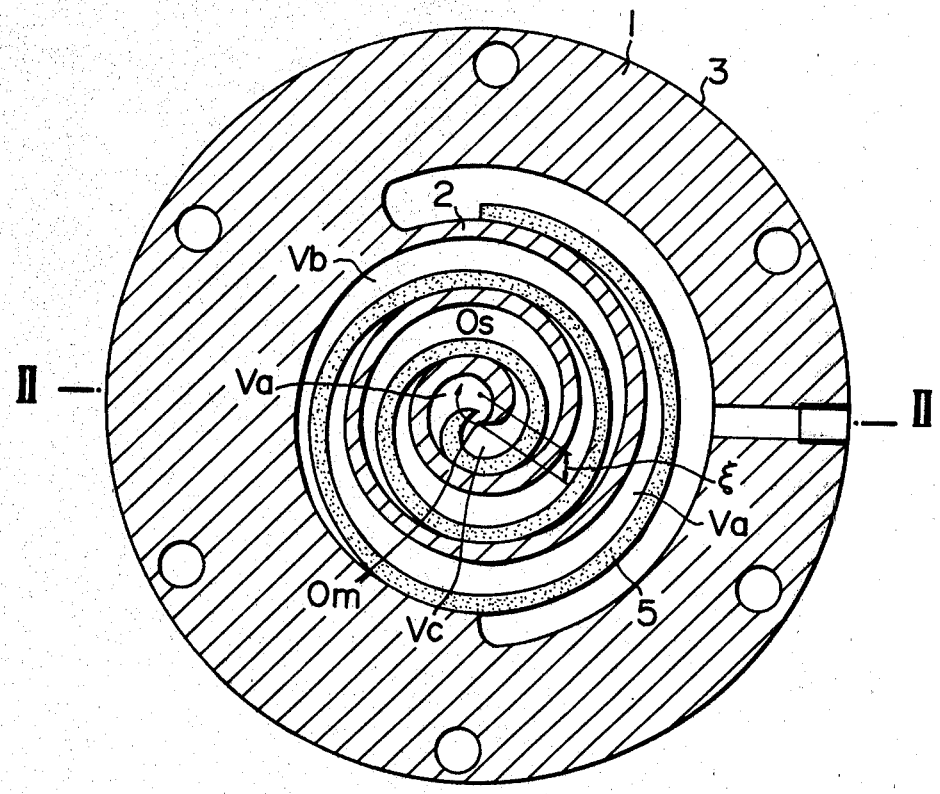
FIG. 1 is a sectional plan view of the scroll fluid apparatus comprising a first embodiment of the invention.
Figure 2:
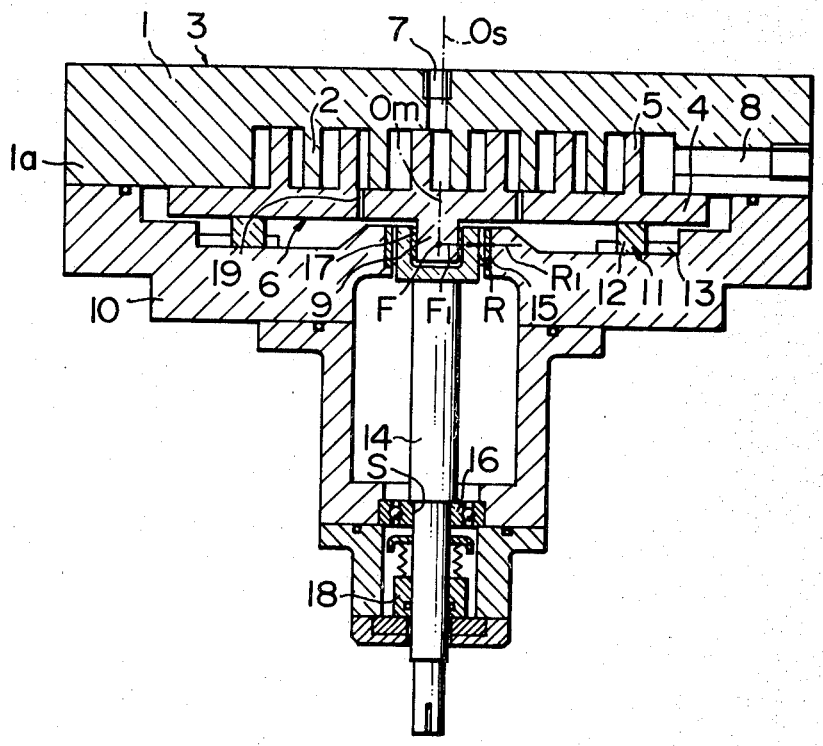
FIG. 2 is a vertical sectional view taken along the line II—II in FIG. 1.

Referring now to the drawings wherein like references numerals are used throughout the various views to designate like parts and, more particularly, to FIGS. 1 and 2, according to these figures, a scroll fluid apparatus comprising a fixed scroll member generally designated by the reference numeral 3 and an orbiting scroll member generally designated by the reference numeral 6 forming a pair and having wraps 2, 5 engaging each other, means 11 for preventing the revolving scroll member from rotating on its own axis, a crankshaft 14 for transmitting rotary force to the orbiting scroll member 6 to cause same to move in orbiting movement and for taking out rotary force from the orbiting scroll member 6, a plurality of bearings 15, 16 for journaling the crankshaft for rotation, and a frame 10 for supporting the bearings.

The fixed scroll member 3 includes an end plate 1 having a cylindrical portion 1*a* at its outer periphery and the wrap 2, of vortical form in involute or similar curve, located on the end plate 1 in upstanding position. The end plate 1 is formed with a high-pressure fluid port 7 in the central portion and a low-pressure fluid port 8 in the cylindrical portion 1*a*. The high-pressure port 7 serves as an outlet port for gas under high pressure when the apparatus functions as a compressor, as an inlet port for working gas of high pressure and high temperature when the apparatus functions as an expander, and as an outlet port for liquid when the apparatus functions as a hydraulic pump. The low-pressure fluid port 8 serves as an inlet port for gas when the apparatus functions as a compressor, as an outlet port for expanded gas when the apparatus functions as an expander, and as an inlet port for liquid when the apparatus functions as a hydraulic pump.

The orbiting scroll member 6 includes an end plate 4 of the disk shape, with the wrap 5 being of a shape similar to that of the wrap 1 located on the end plate 4 in upstanding position. A pin 9 is attached to a side face of the end plate 4 (hereinafter referred to as a back face) opposite the side face at which the wrap 5 is located.

A frame 10 is connected by bolts, not shown, to the cylindrical portion 1*a* of the fixed scroll member 3 and has a space for containing the orbiting scroll member 6 therein.

The means 11 for preventing the orbiting scroll member 6 from rotating on its own axis includes a ring 12 and two sets of keys 13. One set of keys 13 is attached to the frame 10, and the other set of keys 13 is attached to the back face of the end plate 4 of the orbiting scroll member 6 and extends in a direction in which it crosses the one set of keys 13 at a right angle. The ring 12 is formed with keyways for engaging the two sets of keys 13.

The crankshaft 14 is journaled for rotation by the two bearings 15 and 16 attached to the frame 10 and has a center of rotation which coincides with the center Os of the fixed scroll member 3. The crankshaft 14 has at one end portion thereof a hole formed in a hub of the frame 10 and a center coinciding with the center Om of the orbiting scroll member 6 and spaced apart a distance $\epsilon$ from the center of rotation Os of the crankshaft 14. A pin 9 is inserted in the hole through a bearing 17.

The bearing 15 closest to the orbiting scroll member 6 is a slide bearing which is located in a plane extending through the point of application F of rotary force transmitted from the crankshaft 14 to the orbiting scroll member 6 (or rotary force transmitted from the orbiting scroll member 6 to the crankshaft 14) and disposed at a right angle to the axis of the crankshaft 14.

Interposed between the frame 10 and the crankshaft 14 is a mechanical seal 18 which prevents leaking of gas through a portion of the frame 10 through which the crankshaft 14 extends.

Two small apertures 19 having a throttling function are formed in the end plate 4 of the orbiting scroll member 6 and allow gas to pass therethrough to the back face of the end plate 4 in a compression stroke or expansion stroke, to apply an axial biasing force to the orbiting scroll member 6. Means for providing an axial biasing force may include a spring and a combination of gas pressure and a spring.

In operation, the center Om of the orbiting scroll member 6 moves in orbiting movement clockwise in FIG. 1 about the center Os of the fixed scroll member 3. With this orbiting of the orbiting scroll member 6, closed spaces Va and Vb (FIG. 1) defined between the two end plates 1 and 4 and two wraps 2 and 5 and located near the terminating points of the wraps 2 and 5, respectively, have their volumes gradually reduced as they move toward the center of the two scroll members 3 and 6.

Conversely, the center Om of the orbiting scroll member 6 moves in orbiting movement counterclockwise in FIG. 1 about the center of Os of the fixed scroll member 3. With this orbiting of the orbiting scroll member 6, closed spaces Vc and Vd (FIG. 1) defined between the two end plates 1 and 4 and two wraps 2 and 5 and located in the center of the two scroll members 3 and 6, respectively, have their volumes gradually increased as they move toward the respective terminating ends of the wraps 2 and 5.

Thus, the apparatus will function as a compressor if the crankshaft 9 is driven to move the orbiting scroll member 6 in orbiting movement clockwise in FIG. 1 by letting the high-pressure fluid port 9 in the center of the fixed scroll member 3 and the low-pressure fluid port 8 in the cylindrical portion 1*a* serve as inlet port and outlet port, respectively. By forming the wraps 2 and 5 in such a manner that the closed spaces Va and Vb are communicated with the low-pressure fluid port 8 as soon as they are formed, the apparatus can be made to function as a hydraulic pump.

Likewise, it is possible to use the apparatus as an expander by passing gas of high temperature and high pressure through the high-pressure fluid port 7 in the center of the fixed scroll member 3.

Figure 3:
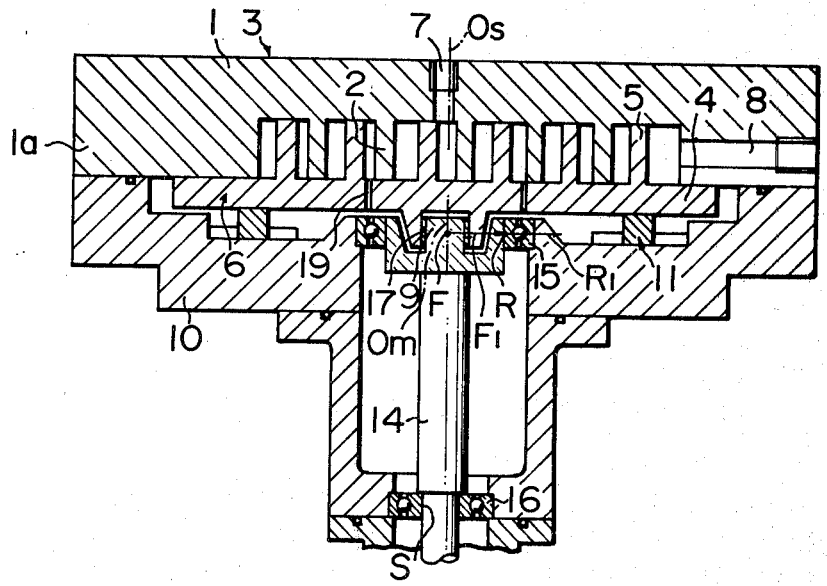
FIG. 3 is a vertical sectional view of the scroll fluid apparatus comprising a second embodiment.

As shown in FIG. 3 the pin 9, which is one of the members for transmitting rotary force between the orbiting scroll member 6 and the crankshaft 14, is attached to an end portion of the crankshaft 14, and a hole is formed in a hub of the orbiting scroll member 6. The bearing 15 is a ball bearing, but a roller bearing may be used as the bearing 15. Other parts of the second embodiment are similar to the corresponding parts of the first embodiment shown in FIGS. 1 and 2. The second embodiment operates in the same manner as the first embodiment, so that description thereof will be omitted.

Figure 4:
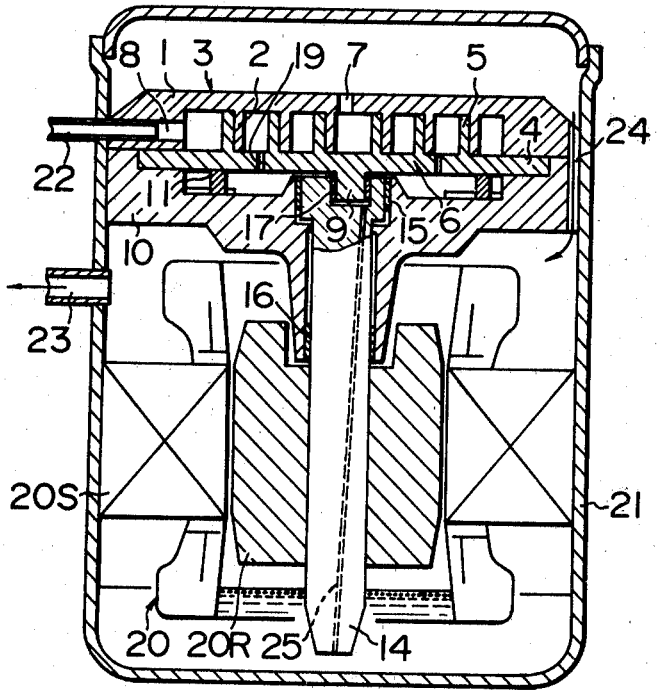
FIG. 4 is a vertical sectional view of the scroll fluid apparatus comprising a third embodiment.

As shown in FIG. 4, in a scroll compressor of the hermetic type, the crankshaft 14 is connected to a rotor 20R of a motor 20 whose stator 20S is secured to the inner wall surface of a hermetic casing 21. A suction line 22 is connected to the low-pressure fluid port 18, and a discharge line 23 is connected to the hermetic casing 21. The fixed scroll member 3 and the frame 10 are each formed with at least one cutout 24 at the outer periphery in positions in which the cutouts 24 of the member 3 and frame 10 are aligned with each other to permit the gas to flow through the cutouts 24 to the motor 20. The crankshaft 14 is formed with a bore 25 extending axially thereof from the upper end to the lower end at which the center of the bore 25 coincides with the center of rotation of the crankshaft 14. The bore 25 is eccentric at the upper end with respect to the center of rotation of the crankshaft 14, so that this mechanism functions as a pump upon rotation of the crankshaft 14 to supply oil at the bottom of the hermetic casing 21 to the sliding parts and bearings. Other parts are similar to the corresponding parts of the first embodiment shown in FIGS. 1 and 2.

Upon actuation of the motor 20, the orbiting scroll member 6 moves in orbiting movement and gas (refrigerant, air, etc.) is drawn by suction into the compressor through the suction line 22 and low-pressure fluid port 8. The gas is compressed and discharged into the hermetic casing 21 through the high-pressure fluid port 7, from which the gas passes through the cutouts 24 to a chamber in the casing 21 on the side of the motor 20. From the chamber on the side of the motor 20, the gas is discharged through the discharge line 23. When the apparatus is intended to compress a refrigerant in a gaseous state, the gas flowing through the discharge line 23 is supplied to a condenser.

From the time the compressed gas is discharged through the high-pressure port 7 until the time it flows into the discharge line 23, the oil entrained in the compressed gas is removed therefrom by force of gravity as the gas changes the direction of its flow and impinges on the walls. Baffle plates, demisters, etc., may be mounted in the hermetic casing 21 as means for positively removing the oil from the compressed gas.

The advantages offered by the feature of the invention that the bearing 15 is located in a plane extending through the point of application F of force and disposed at a right angle to the center axis of the crankshaft 14 in the first to third embodiments will now be described.

(1) The point of application F of force and the point of support R of the bearing 15 are in the same plane and distance $\overline{FR}$ has a zero value, so that the load applied to the bearing 15 can be reduced. This relationship can be expressed by the following equations:

$$R_1 = F_1(1 + FR/RS)$$

$$\overline{FR} = 0$$

$$\therefore R_1 = F_1.$$

Thus, the bearing 15 merely bears a force $F_1$ applied to the point F. This is conducive to prolonged service life of the bearing 15, and inspection and maintenance can be carried out at longer intervals.

(2) The distance $\overline{FR}$ has a zero value, so that no moment is applied to the crankshaft 14. This eliminates a load applied to the bearing 16 which has only to bear a force large enough to support the crankshaft 14 in position.

(3) As stated in paragraph (2), the function of the bearing 16 is merely to support the end of the crankshaft 14. This makes it possible to reduce the distance FS from the point of application F of force to thereby reduce the axial length.

(4) The fact that no moment is applied to the crankshaft 14 means that the crankshaft 14 does not wobble during rotation, thereby minimizing noise production.

What is claimed is:

1. A scroll fluid apparatus comprising a pair of scroll members each including an end plate and a wrap of vortical form located on the end plate in an upright position, the pair of scroll members being assembled in superposed relationship with the wraps engaging each other, means for preventing one of the scroll members from rotating on its own axis but allowing said one scroll member to orbit with respect to the other scroll member, and a crankshaft connected to the orbiting scroll member in a force transmission relationship, characterized in that a plurality of bearings are provided for journalling the crankshaft, a center of a bearing closest to the orbiting scroll member is located substantially in a plane extending through a point of application of force transmitted between the orbiting scroll member and the crankshaft such that no moment is applied to the crankshaft by the force and the reaction force thereto from said closest bearing, and in that the bearing closest to the orbiting scroll member is disposed at a right angle to a center axis of the crankshaft.

2. A scroll fluid apparatus as claimed in claim 1, wherein said bearing closest to the orbiting scroll member is a slide bearing.

3. A scroll fluid apparatus as claimed in claim 1, wherein said bearing closest to the orbiting scroll member is a roller bearing.

4. A scroll fluid apparatus as claimed in claim 3, wherein the roller bearing is a ball bearing.

5. A scroll fluid apparatus comprising:

a fixed scroll member including an end plate having a cylindrical portion at its outer periphery and a wrap of vortical form located thereon in an upstanding position;

an orbiting scroll member including an end plate and a wrap of vortical form located thereon in an upstanding position;

a frame connected to the cylindrical portion of said fixed scroll member;

a crankshaft supported by said frame for rotation and maintained in engagement with said orbiting scroll member by means of a pin and a hub rotatably engaging said pin;

at least two bearings interposed between said crankshaft and said frame, a center of the bearing closest to said orbiting scroll member being located substantially in a plane extending through a point of application of force transmitted between said orbiting scroll member and said crankshaft such that no moment is applied to the crankshaft by the force and the reaction force thereto from said closest bearing, and the bearing closest to the orbiting scroll member is disposed at a right angle to the center axis of said crankshaft;

means for preventing said orbiting scroll member from apparently rotating on its own axis;

a low pressure fluid port; and a high pressure fluid port.

6. A scroll fluid apparatus as set forth in claim 1 or 5, wherein said bearings are two in number and spaced apart from each other.

7. A scroll fluid apparatus as claimed in claim 6, wherein said bearings are all roller bearings.

8. A scroll fluid apparatus as claimed in claim 6, wherein one of said bearings is a roller bearing and the other bearing is a slide bearing.

9. A scroll fluid apparatus as claimed in claim 6, wherein said bearings are all slide bearings.

* * * * *